US008887428B1

(12) United States Patent
Lemoine

(10) Patent No.: US 8,887,428 B1
(45) Date of Patent: Nov. 18, 2014

(54) VARIABLE CAPACITY MODULAR FIREARM MAGAZINE

(71) Applicant: Eric Lemoine, Winter Garden, FL (US)

(72) Inventor: Eric Lemoine, Winter Garden, FL (US)

( * ) Notice: Subject to any disclaimer, the term of this patent is extended or adjusted under 35 U.S.C. 154(b) by 0 days.

(21) Appl. No.: 13/974,781

(22) Filed: Aug. 23, 2013

(51) Int. Cl.
*F41A 9/71* (2006.01)
*F41A 9/61* (2006.01)
*F41A 9/63* (2006.01)

(52) U.S. Cl.
CPC ... *F41A 9/63* (2013.01); *F41A 9/71* (2013.01); *F41A 9/61* (2013.01)
USPC ..... 42/49.02; 42/50; 42/49.01

(58) Field of Classification Search
CPC ..... F41A 9/61; F41A 9/63; F41A 9/64; F41A 9/65; F41A 9/68; F41A 9/71
USPC ..... 42/50, 49.01, 49.02, 49.1, 106; 89/33.1
See application file for complete search history.

(56) References Cited

U.S. PATENT DOCUMENTS 5,113,605 A * 5/1992 Kim ..... 42/50
5,168,648 A 12/1992 Brandl et al.
5,438,783 A 8/1995 Sniezak et al.
5,495,687 A * 3/1996 Waiser ..... 42/50
5,526,600 A * 6/1996 Chesnut et al. ..... 42/50
5,666,752 A * 9/1997 Grams ..... 42/49.02
7,191,556 B2 * 3/2007 Pikielny ..... 42/7
7,200,964 B2 * 4/2007 Gates ..... 42/50
7,886,468 B1 * 2/2011 Pontollo, II ..... 42/50
8,006,423 B1 * 8/2011 Alzamora et al. ..... 42/49.01
8,572,877 B2 * 11/2013 Sullivan ..... 42/50
8,607,489 B1 * 12/2013 Calvert ..... 42/49.01
2005/0188579 A1 * 9/2005 Gates ..... 42/50
2010/0281737 A1 * 11/2010 Cahill ..... 42/50
2012/0073429 A1 * 3/2012 Bowles et al. ..... 89/138
2012/0131831 A1 * 5/2012 Sullivan et al. ..... 42/50
2012/0167429 A1 * 7/2012 Sullivan ..... 42/50
2012/0246988 A1 * 10/2012 Ladner ..... 42/49.02
2013/0255125 A1 * 10/2013 Bath ..... 42/50
2014/0020275 A1 * 1/2014 Corso ..... 42/49.01
2014/0053446 A1 * 2/2014 Sullivan ..... 42/50

* cited by examiner

*Primary Examiner* — Jonathan C Weber
(74) *Attorney, Agent, or Firm* — Jason T. Daniel, Esq.; Daniel Law Offices, P.A.

(57) ABSTRACT

A variable capacity modular firearm magazine includes one or more modular magazine bodies, each having connectors to allow the plurality of bodes to be removably secured together in a vertical manner, a receiver member having a coupler that is removably secured to the uppermost magazine body, a baseplate having a coupler that is removably secured to the lowermost magazine body, and a cartridge engagement unit that is disposed within each of the bodies and receiver member.

15 Claims, 10 Drawing Sheets

VARIABLE CAPACITY MODULAR FIREARM MAGAZINE

TECHNICAL FIELD

The present invention relates generally to firearm magazines, and more particularly to a firearm magazine having modular components for allowing variable capacity.

BACKGROUND

The statements in this section merely provide background information related to the present disclosure and may not constitute prior art.

In the field of semi-automatic firearms, it is customary to provide a tube-type magazine which holds in vertical relationship a fixed number of rounds of ammunition which are sequentially fed into the chamber of the gun. In loading the gun, the magazine or clip is inserted into a magazine opening (magwell) that is positioned along the underside of the gun. Once inserted into the magwell, the magazine is locked in place and functions to provide a new round as each successive round is fired. To this end, conventional firearm magazines are constructed to accommodate a set number of rounds (5, 10, 15, etc., for example), each having a size/caliber that is appropriate for the firearm.

In recent years, an increasing number of government regulations have been passed that function to reduce and/or limit the round capacity of certain types of firearms. As many of these regulations are state specific, gun owners are finding that some of their firearm magazines are legal in one state, and illegal in other states. In addition to confusion among gun owners, manufacturers of firearm magazines are being forced to expel vast sums of money to create new products having the state-specified capacity, and to ensure that only those products meeting the guidelines are shipping to those specific jurisdictions.

Accordingly, these and other such difficulties have been obviated in a novel manner by the variable capacity modular firearm magazine described herein.

SUMMARY OF THE INVENTION

The present invention is directed to a variable capacity modular firearm magazine. One embodiment of the present invention can include one or more modular magazine bodies capable of receiving and housing a plurality of firearm cartridges. Each of the bodies can be vertically stacked to adjust the total storage capacity. A receiver member having any number of couplers can be removably secured to the uppermost magazine body, and a baseplate can be removably secured to the lowermost magazine body. A cartridge engagement unit can be disposed within the bodies and receiver member.

In another embodiment, the cartridge engagement unit can include a plurality of springs which can be joined by a spring coupler, and a follower.

In yet another embodiment, each of the magazine bodies and/or the plurality of springs can include identical or different lengths and materials.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
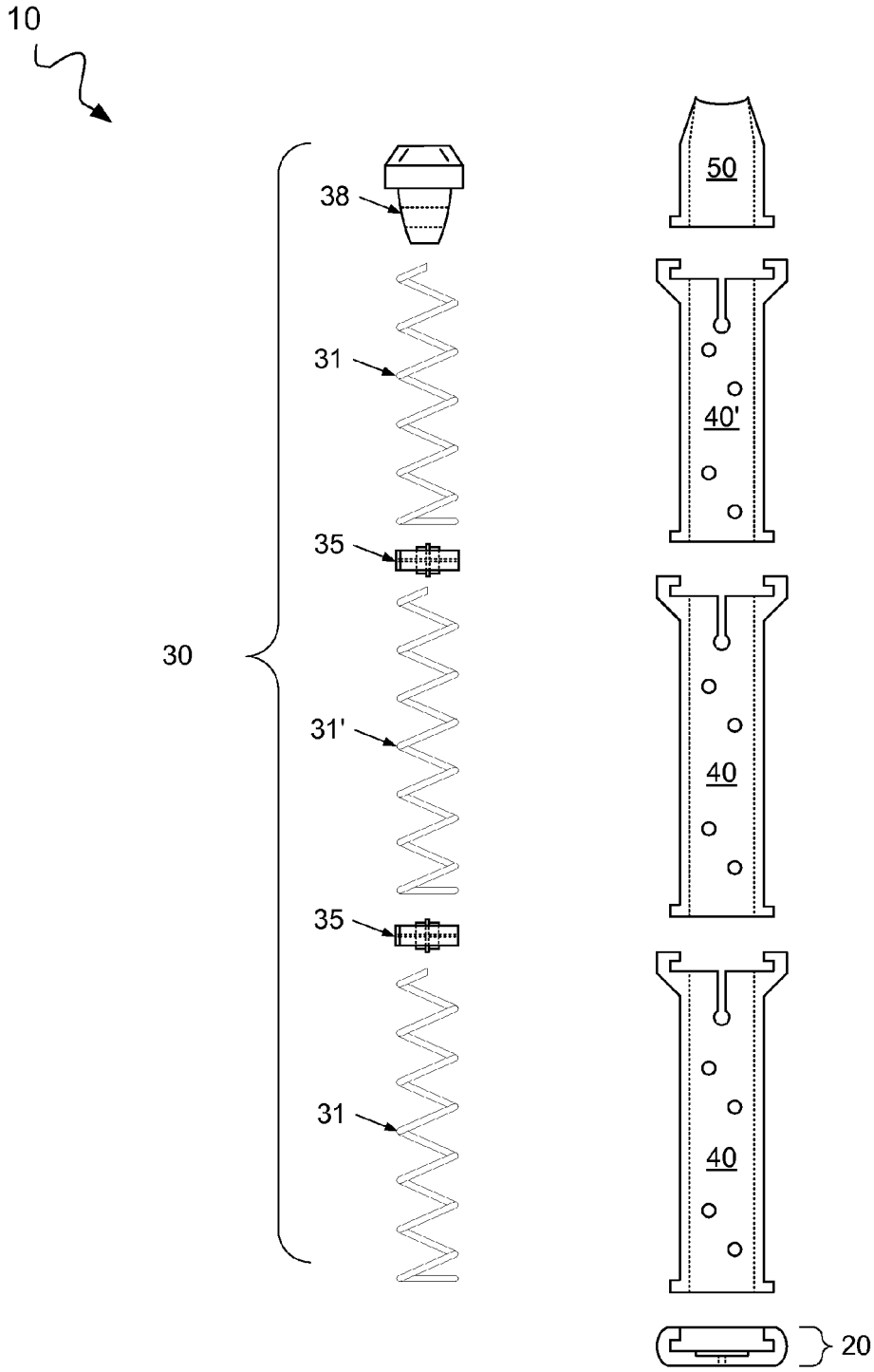
FIG. 1 is an exploded parts view of the variable capacity modular firearm magazine, that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As described herein, the term "firearm" can refer to virtually any type, manufacturer and caliber of semi-automatic and/or manually operated weapons including handguns, rifles and/or shotguns, for example. Moreover, the terms "rounds" and "cartridge" are used interchangeably to refer to any form of ammunition for a firearm such as handgun and riffle bullets, and shotgun shells, for example. To this end, the variable capacity modular firearm magazine described herein can be manufactured to include an overall size, shape and dimension capable of accommodating cartridges of any caliber, and by any manufacturer. As such, the presently claimed invention is not to be construed as limiting with regard to any particular type and/or caliber rounds.

The basic construction and components of a conventional fixed length firearm magazine are known, and include U.S. Pat. No. 5,438,783, to Sniezak, the contents of which are incorporated herein by reference.

FIG. 1 illustrates an expanded parts view of the variable capacity modular firearm magazine 10 that is useful for understanding the inventive concepts disclosed herein. As shown, the magazine 10 can include a butt plate 20, a cartridge engagement unit 30, one or more modular bodies 40, and a receiver member 50.

Figure 2:
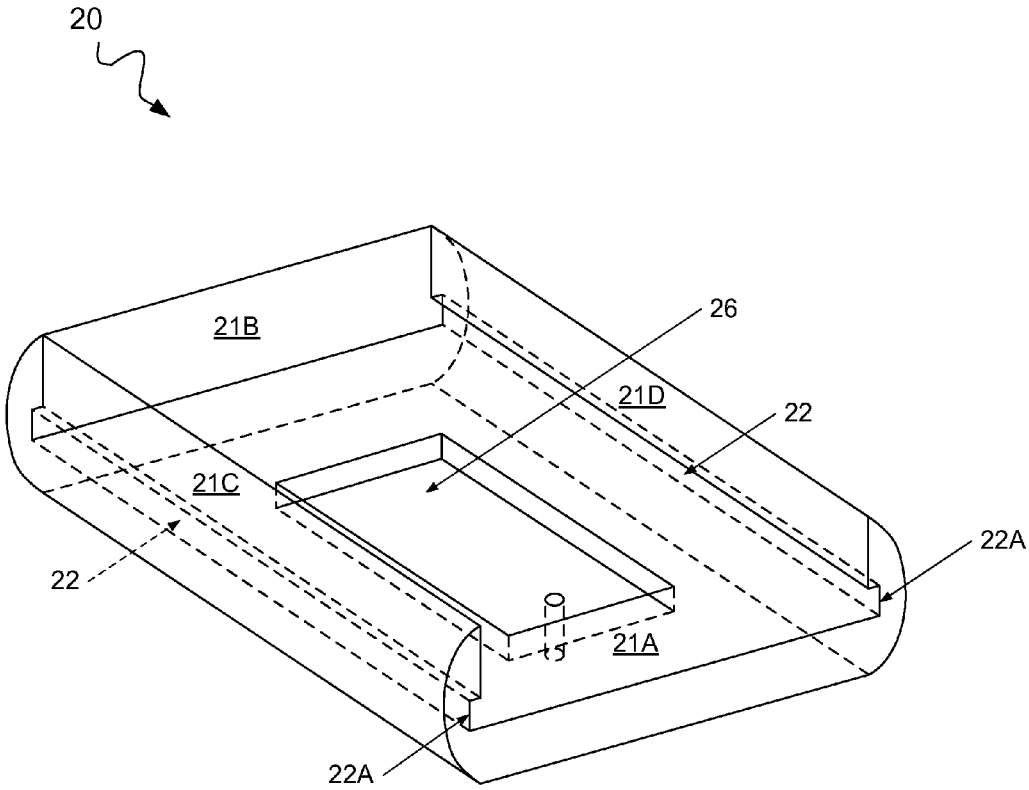
FIG. 2 is a perspective view of the butt plate of the variable capacity modular firearm magazine, in accordance with one embodiment of the invention.

FIG. 2 illustrates one embodiment of the butt plate 20 of the modular firearm magazine 10. As shown, the butt plate can include a main body having a bottom wall 21*a*, an end wall 21*b*, and a pair of opposing side walls 21*c* and 21*d*. Each of the walls 21*b*, 21*c* and 21*d* preferably having an orthogonal relationship with the bottom wall 21*a*. A pair of longitudinally extending grooves 22 having an open back end 22*a* are disposed along the side walls 21*c* and 21*d*, respectively. Each of the grooves 22 including a dimension suitable for receiving the flanges 44 of the lowermost modular body 40 described below. Such a feature can allow the butt plate to slidably engage the modular body in a controlled and linear manner, so as to permit operation of the magazine as described throughout this document.

A spring retention cavity 26 can be disposed along the bottom wall 21*a* which functions to receive and securely position the bottom end of a spring 31*a*, as described below.

In the preferred embodiment, the butt plate 20 can preferably be constructed from a sturdy material such as metal or plastic, for example, and can include a shape and dimension suitable for aligning and engaging a modular body 40 described below. Of course, any number of other materials is also contemplated.

Figure 3A:
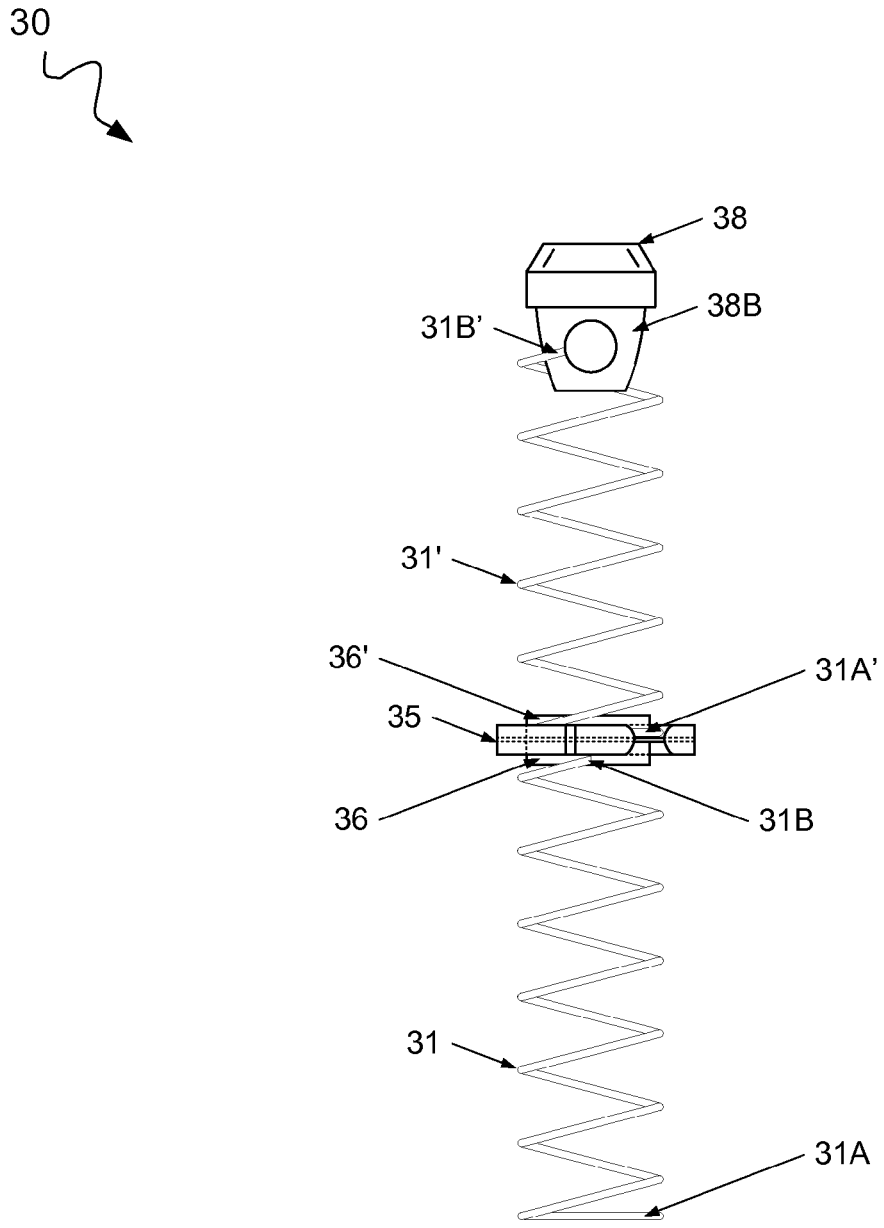
FIG. 3A is a side elevation view of the cartridge engagement unit of the variable capacity modular firearm magazine, in accordance with one embodiment of the invention.

FIG. 3A illustrates one embodiment of the cartridge engagement unit 30 of the modular firearm magazine 10. As shown, the cartridge engagement unit can include one or more springs 31 and 31', one or more spring connectors 35 and a follower 38.

Figure 3B:
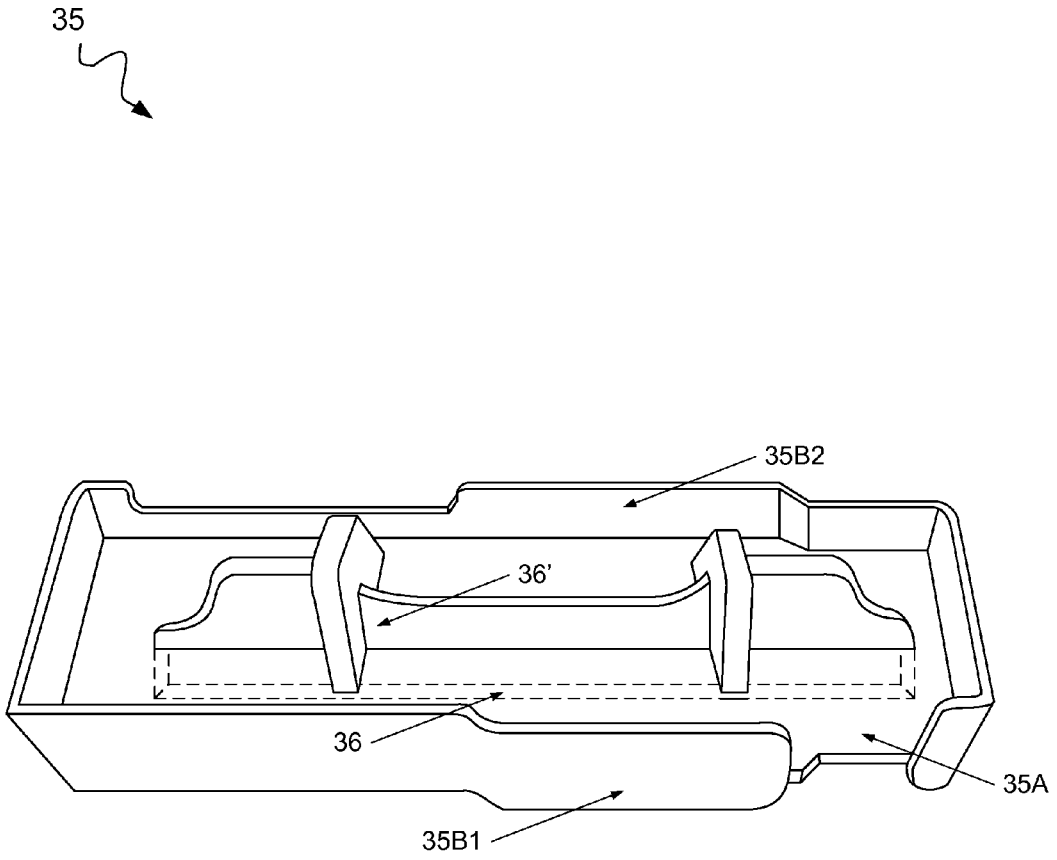
FIG. 3B is a perspective view of the spring connector of the cartridge engagement unit of FIG. 3A.

As shown in FIG. 3B, the spring connector 35 can include a generally planar central member 35*a* having a shape and dimension that is complementary to, and suitable for being housed within the modular body 40. A pair of generally orthogonal side walls 35*b*1 and 35*b*2 can be disposed along the outer edges of the planar member 35*a*, to prevent the connector from rotating when installed within the modular bodies. Additionally, a pair of spring retention members 36' and 36 each including an elongated protruding section emanating from the planar member can extend in an upward and downward orientation, respectively. To this end, the protrusions 36 and 36' can extend into the central portion of the spring end so as to be surrounded by the oval shaped edge of the spring, while the raised side walls function to prevent separation of the spring and protrusion.

Figure 3C:
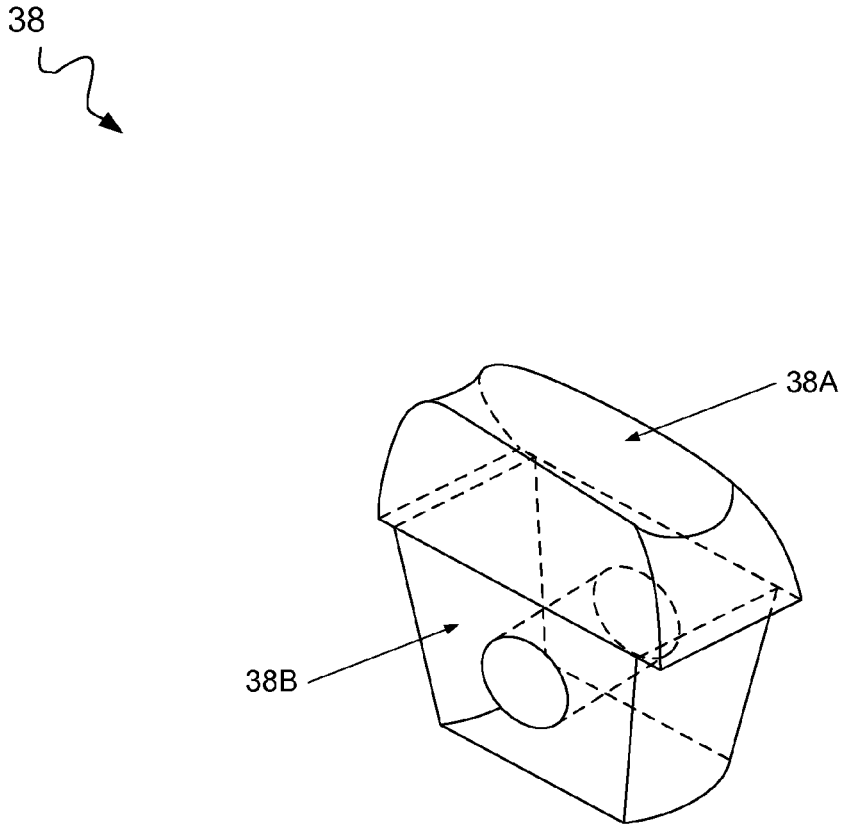
FIG. 3C is a perspective view of the follower of the cartridge engagement unit of FIG. 3A.

FIG. 3C illustrates one embodiment of the follower 38 of the cartridge engagement unit 30. The follower can function in a traditional manner to engage the lowermost cartridge housed within the body 40 and apply an upward pushing motion until the cartridge is removed from the receiver member 50. To this end, one embodiment of the follower 38 can include a generally curved upper surface 38*a*, and a lower surface having a spring engagement member 38*b* extending downward therefrom. As described herein the spring engagement member 38*b* can be essentially identical to the spring retention members 36 and 36' described above. However, any device capable of maintaining a connection between the spring and the follower can also be utilized herein.

The springs 31 and 31' can function in a traditional manner to compress and expand within one or more of the modular bodies 40. To this end, the bottom end 31*a* of the lowermost spring 31 can removably engage the member 26 of the butt plate 20, and the upper end 31*b'* of the uppermost spring 31' can removably engage the spring engagement member 38*b* of the follower 38. When two or more springs are utilized within the firearm magazine 10, as illustrated in FIG. 3A, the upper end 31*b* of the lower spring 31 can engage the lower protrusion 36, and the lower end 31*a'* of the upper spring 31' can engage the upper protrusion 36', as described above. Of course, the spring (s) can also engage the respective elements utilizing any known device capable of securing the same together in a removable manner.

As described herein, each element of the cartridge engagement unit 30 can preferably be constructed from a suitable material such as metal or plastic, for example. Additionally, each of the springs 31 and 31' can include identical or different lengths (measured from the top end to the bottom end of the spring) and/or construction materials.

Although illustrated as including two springs 31 and 31' and a single connector 35, this is for illustrative purposes only, as other embodiments comprising a single spring without a connector 35 (See FIG. 8) or a plurality of springs and connectors (See FIG. 1) are also contemplated, depending on total number of modular bodies to be utilized in the completed magazine.

Figure 4:
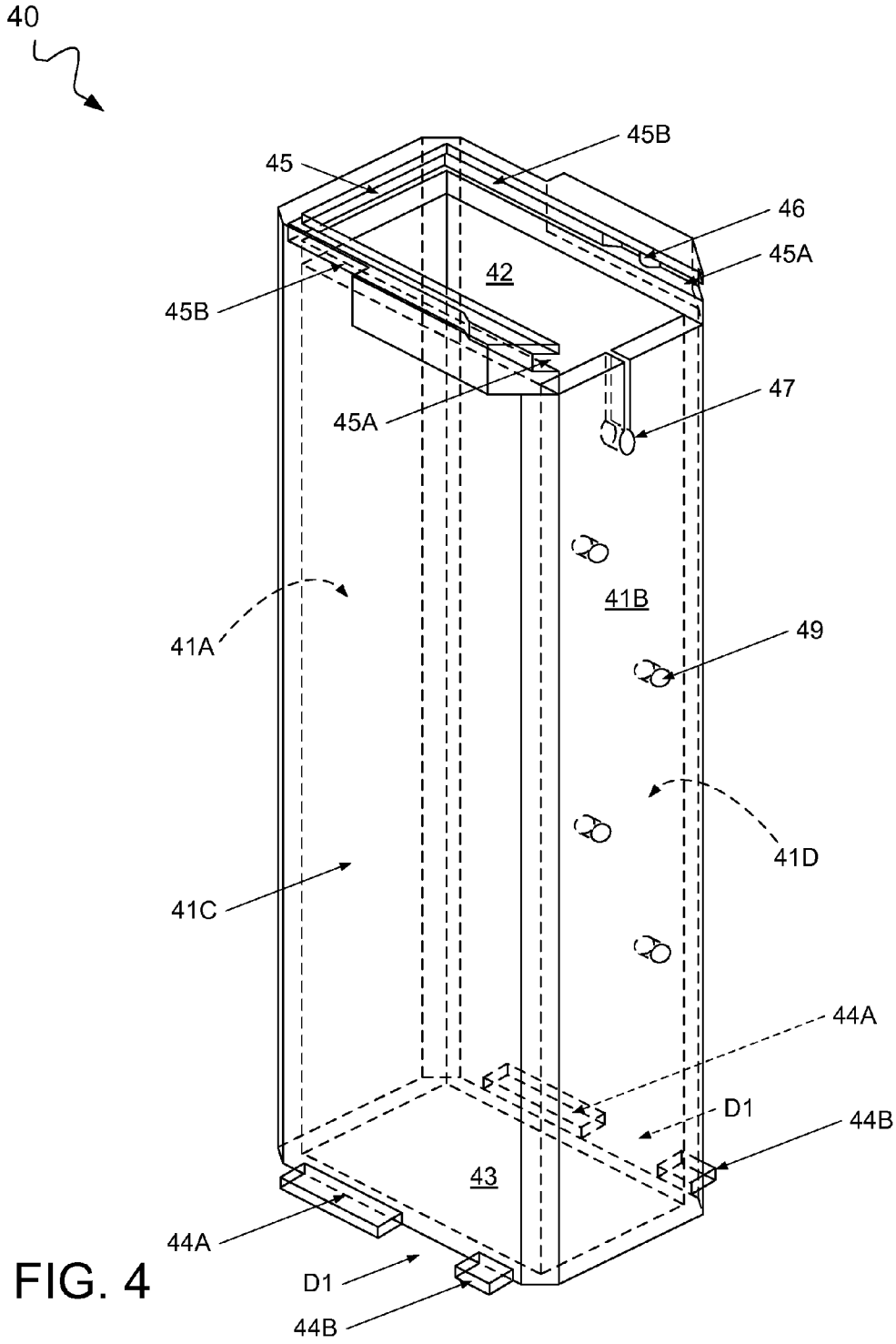
FIG. 4 is a perspective view of a modular body of the variable capacity modular firearm magazine, in accordance with one embodiment of the invention.

FIG. 4 illustrates one embodiment of a modular body 40 of the magazine 10. As shown, the body 40 can include a rigid, elongated hollow tubular member having a generally rectangular cross-section that includes a front wall 41*a*, a rear wall 41*b*, and a pair of opposing side walls 41*c* and 41*d*, forming an open upper end 42 and an open lower end 43. The body 40 can function to receive, hold and stack a plurality of firearm cartridges in parallel relation with each other. Any number of optional holes 49 can also be disposed onto the body 40 in order to provide a visual indication of the presence and number of cartridges that are located within the body.

As shown, an elongated flange 44*a* and a short flange 44*b* (referred to throughout this document as flange 44) can be disposed along the lower edges of each of the side walls 41*c* and 41*d*. Each of the flanges extending longitudinally outward from the side walls and are separated by a distance D1. Additionally, an elongated channel 45 can be disposed along the upper surfaces of the front wall 41*a* and the side walls 41*c* and 41*d*. As shown, the channel can include a wide section 45*a* and a narrow section 45*b* (measured from the distance between side walls 41*c* and 41*d*), and a pair of protruding nubs 46 that are disposed within the wide section of the channel 45*a*.

As described herein, each of the channels 45 and flanges 44 include complementary shapes and dimensions, and are also positioned at complementary locations along the top and bottom surfaces of the body 40 so as to allow the channels 45 on top of one body to receive the flanges 44 located on the bottom of another body. Additionally, each of the nubs 46 correspond to the spaces D1 between the flanges 44*a* and 44*b*, and function as a locking mechanism to prevent separation of the bodies when stacked. Such a feature resulting in a single assembled body having a smooth and continuous shape for receiving and stacking firearm cartridges.

In one embodiment, one or more of the bodies 40 can further include an expansion gap 47 having an elongated narrow slit terminating into an open section along the back wall 41*b* at a location adjacent to the top surface 42. The gap 47 functioning to allow the width of the upper portion of the body to expand and contract in order to allow the flanges 44 to engage and disengage the channel 45. In this regard, as the flanges 44*a* of a first body slide past the nubs 46 of a second body, the gap 47 of the second body will expand until the spaces D1 between the flanges are in communication with the nubs. At this time, the gap will contract to prevent separation of the bodies.

Although only a single body 40 is illustrated in FIG. 4, any number of modular bodies can be included with the magazine 10, depending on the desired cartridge capacity. To this end, each of the bodies can include essentially identical components (i.e., top, bottom, side walls, flanges, channels and gaps), however one or more one or more bodies 40' (See FIG. 1) can include a length (measured from the top end 42 to the bottom end 43) that is different from another of the bodies 40.

In the preferred embodiment, each of the bodies 40 and 40' can be constructed from a sturdy material such as metal or plastic, for example, and can include a shape and dimension suitable for receiving cartridges of any shape and caliber. Of course, any number of other materials is also contemplated, and each of the bodies need not include an identical construction material to function together.

Figure 5:
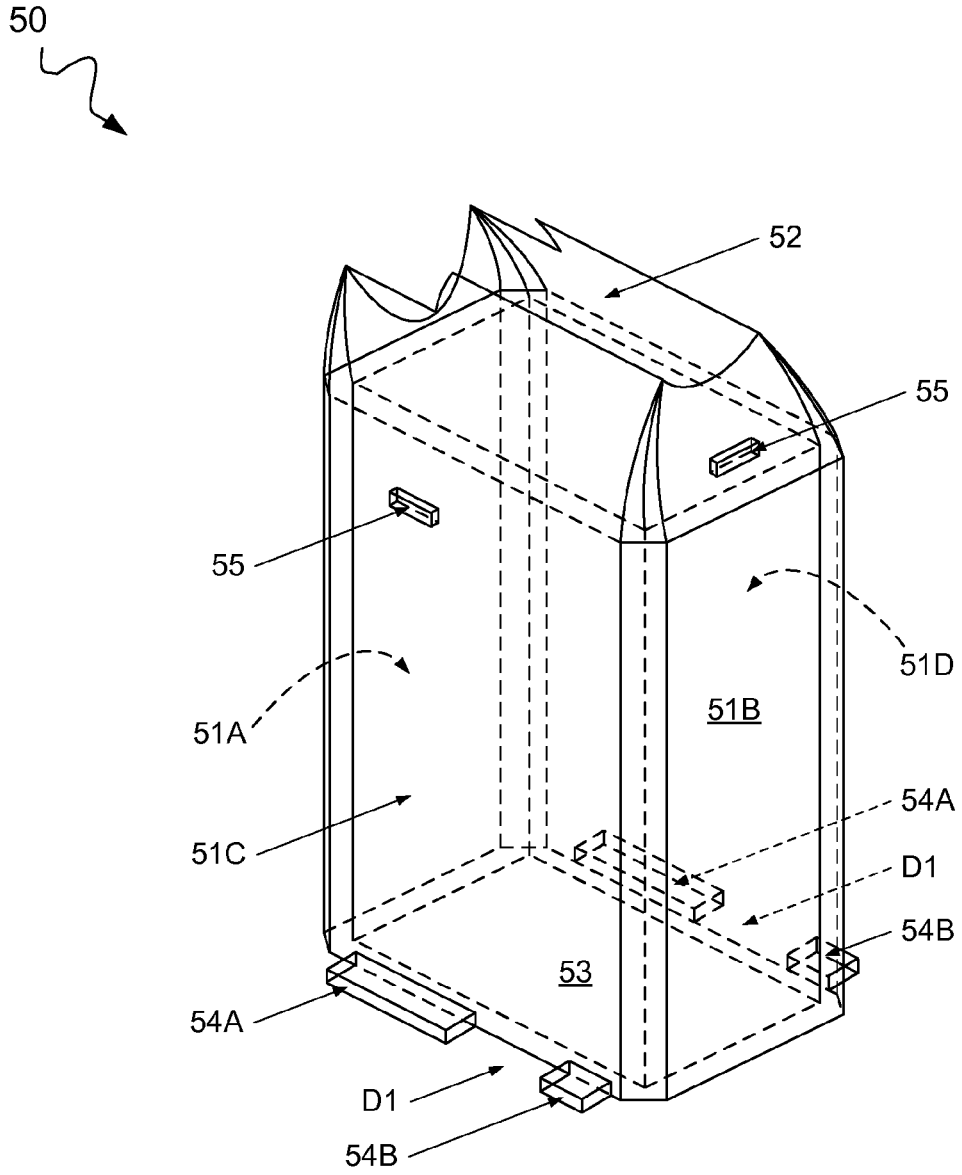
FIG. 5 is a perspective view of the receiver member of the variable capacity modular firearm magazine, in accordance with one embodiment of the invention.

FIG. 5 illustrates one embodiment of the receiver member 50 of the magazine 10. As shown, the receiver member 50 can also include a rigid, elongated hollow tubular member having a front wall 51*a*, a rear wall 51*b*, and a pair of opposing side walls 51*c* and 51*d* forming an open lower end 53. Side walls 51*c* and 51*d* can also include a curved upper half that extends inward toward the center of the receiver body to form an open upper end 52. The receiver member 50 functioning to receive, hold and serially discharge firearm cartridges into a firearm.

As shown, a pair of flanges 54*a* and 54*b* extend outward from the lower edges of each of the side walls 51*c* and 51*d*, and are further separated by the distance D1. Flanges 54*a* and 54*b* are identical to flanges 44*a* and 44*b*, respectively, and function to engage the channel 45 located on the top end of a modular body 40.

As the inventive concepts described herein are equally applicable to cartridges of all shapes and sizes, no specific dimensions are provided. However, it should be apparent to those of skill in the art that the receiver member of the magazine will include an overall outside shape and dimension that is compatible for being received within the magwell of the gun for which the particular cartridge is intended. Moreover, the body 40 and/or receiver member 50 can further include any number of protrusions, grooves, and other such couplers 55 suitable for aligning and engaging the mag-catch of the of the firearm for which the magazine 10 is to be utilized.

Although illustrated and described with respect to a particular flange and groove arrangement, those of skill in the art will recognize that this relationship can be reversed, wherein flanges are located on the butt plate and receiver, and the grooves are located on the top ends of the bodies 40, for example. Moreover, any number of other conventional systems and/or components capable of aligning and securing the various magazine components together in a manner similar to that described above can also be utilized herein. As such, any form of securing devices and/or any additional locking features suitable for ensuring that the components remain locked together when assembled shall be referred to hereinafter as "fasteners". Moreover, the term "removably secure" refers to the ability of the fasteners (which include the flange and channel arrangements described above) to secure the magazine components together in a manner which allows the components to be repeatedly engaged and disengaged.

Figure 6:
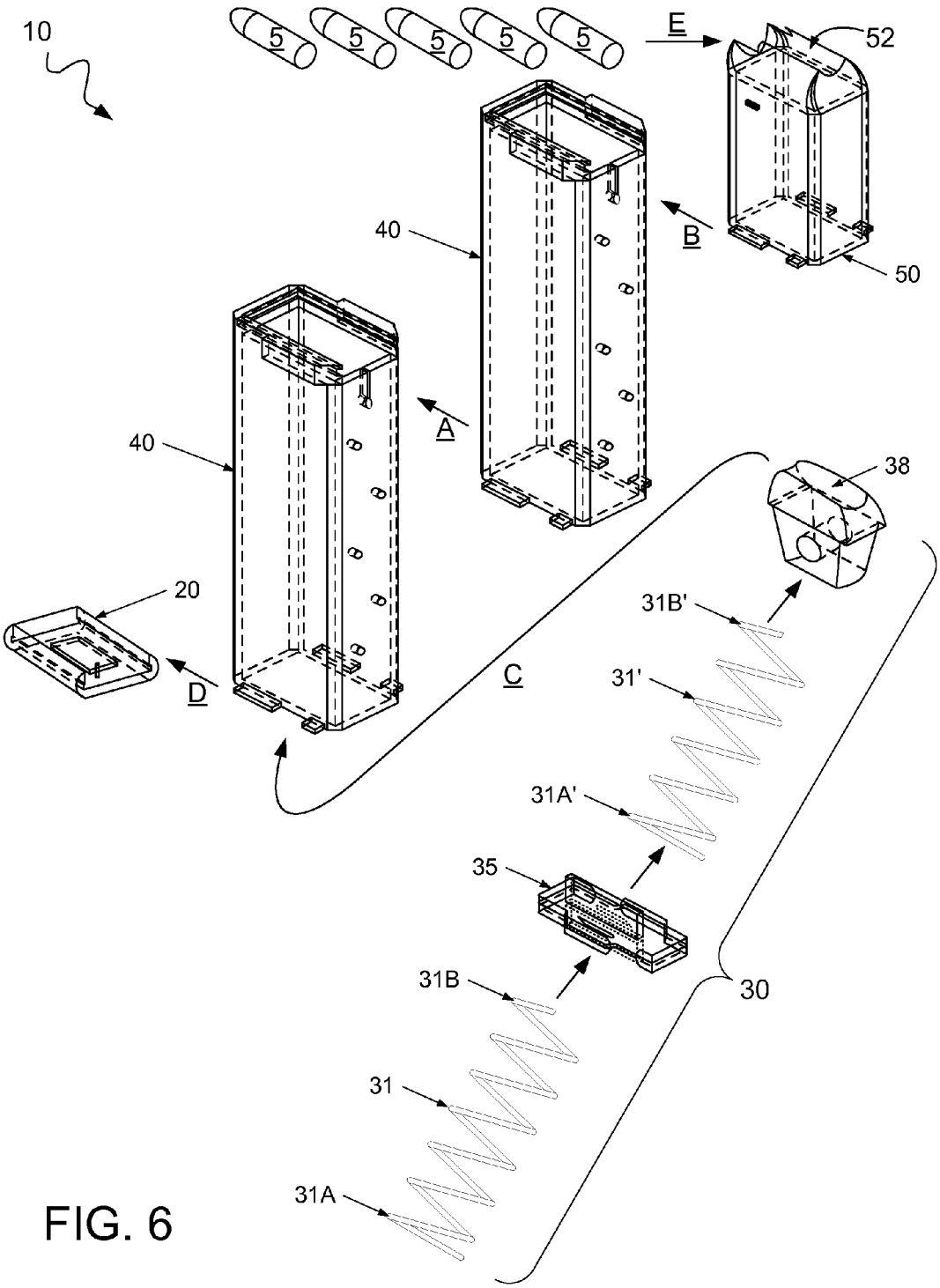
FIG. 6 is an exploded parts view of the variable capacity modular firearm magazine being assembled, in accordance with one embodiment of the invention.
Figure 7:
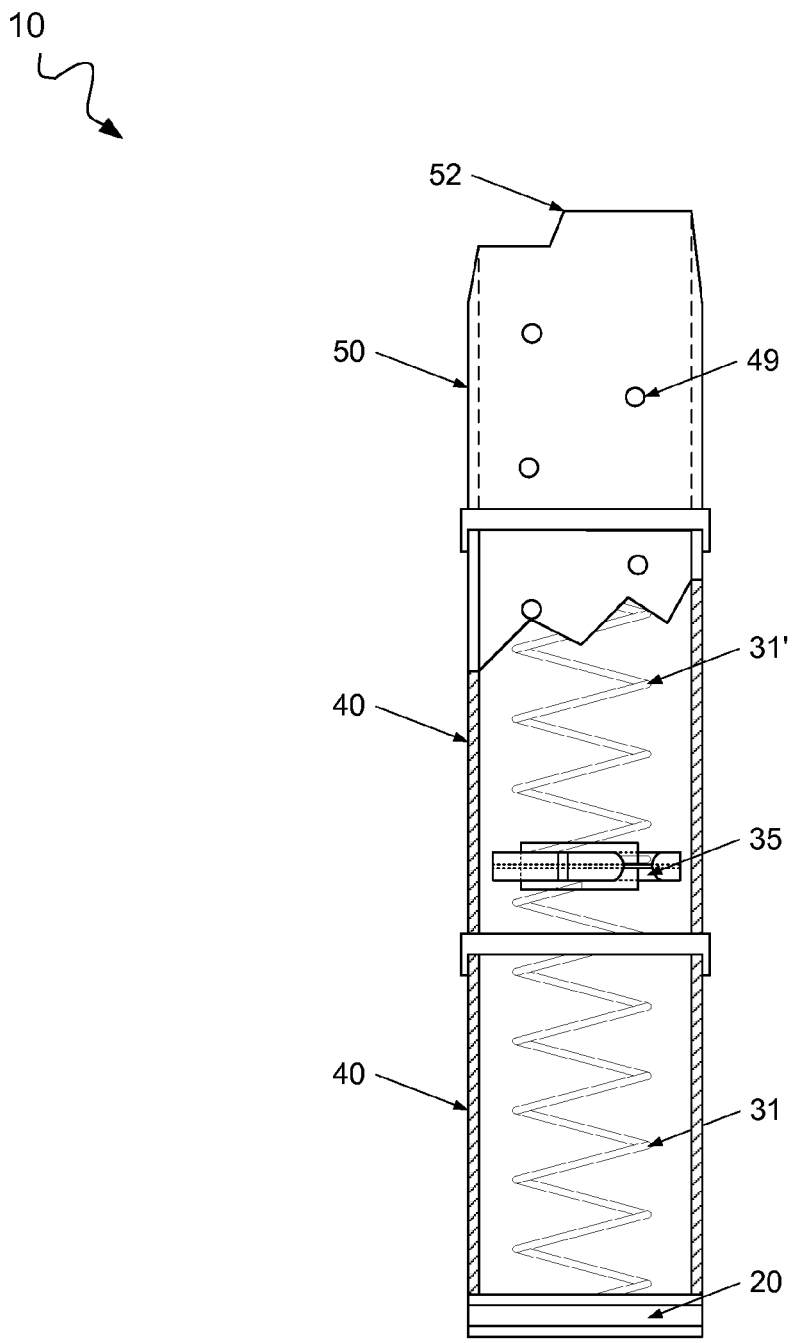
FIG. 7 is a cross-sectional elevational view of an assembled variable capacity modular firearm magazine, in accordance with one embodiment of the invention.

FIGS. 6 and 7 illustrate the assembly of the variable capacity modular firearm magazine 10 in accordance with one embodiment. As shown, the bodies 40 can be aligned and slidably engaged via the complementary channels and flanges (see arrow A) to create a single uniformly shaped elongated tubular body. In this example, only two bodies are illustrated, however any number of modular bodies can be provided to increase the capacity of the magazine. Next, the receiver member 50 can be connected to the uppermost body (see arrow B) in the same manner. Once each of the modular bodies 40 and receiver 50 are assembled, the cartridge engagement unit 30 can be assembled and loaded through the bottom end of the lower body 40, as shown by arrow C. In this example, the cartridge engagement unit 30 includes two springs 31 and 31' connected via a single spring connector 35 and a follower 38. However, other embodiments having more or less springs and/or connectors are also contemplated. Finally, the butt plate 20 can be connected to the lowermost body (see arrow D) utilizing the flanges and grooves, at which time the retention cavity 26 can engage the bottom end of the lowermost spring 31*a*. When so positioned, a plurality of individual cartridges 5 can be loaded and discharged through the top end of the receiver member 52 (See arrow E) in a conventional manner for use by the respective firearm.

Figure 8:
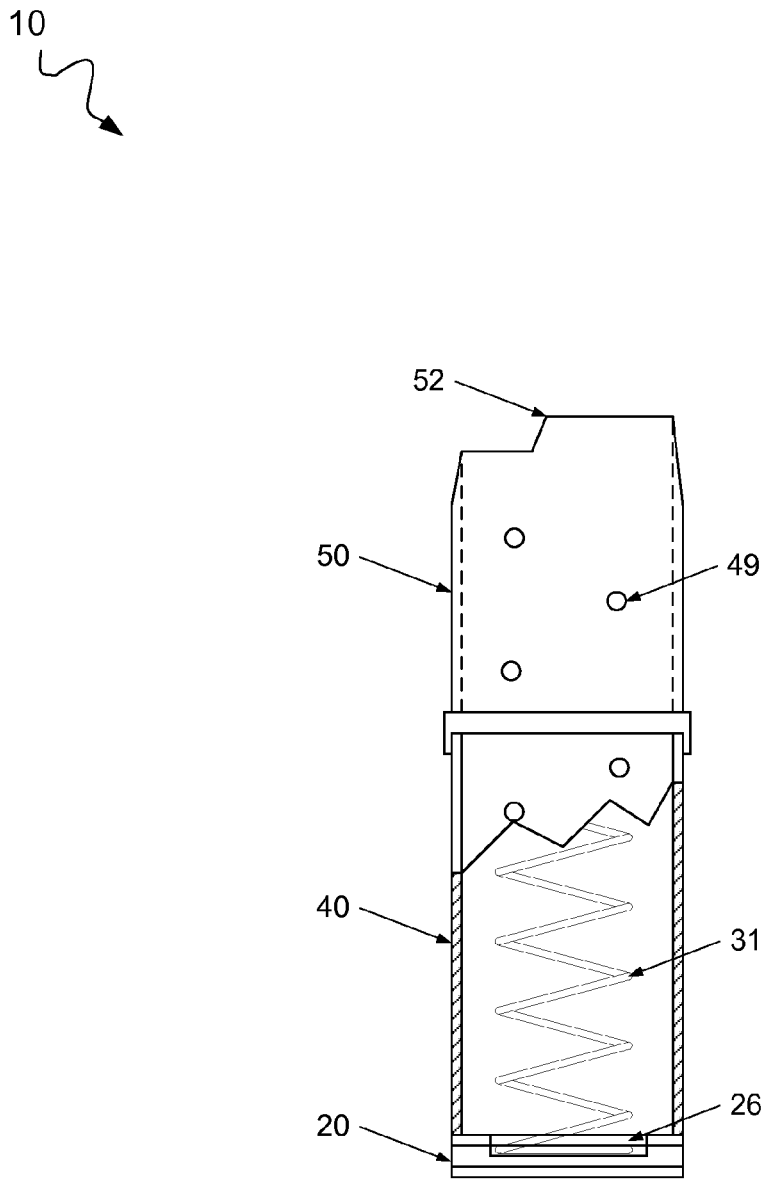
FIG. 8 is a cross-sectional elevational view of an assembled variable capacity modular firearm magazine, in accordance with another embodiment of the invention.

Although described above as including a plurality of springs and multiple bodies, this is for illustrative purposes only, as any number of other embodiments is also contemplated. For example, FIG. 8 illustrates another embodiment of the variable capacity modular firearm magazine 10 that includes a cartridge engagement unit having only a single spring 31, a single butt plate 20, a single body 40 and a receiver member 50.

Accordingly, the variable capacity modular firearm magazine 10 functions to provide an unlimited number of options pertaining to cartridge capacity for virtually any type of firearm.

As described herein, one or more elements of the variable capacity modular firearm magazine 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more of the individually identified elements may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A variable capacity modular firearm magazine, comprising:

a butt plate having a front wall, a pair of opposing side walls, and a spring retention cavity disposed along a bottom wall;

one or more rigid modular bodies, each including an elongated hollow tubular shape having a front side wall, a back side wall and a pair of opposing side walls defining an open top end and an open bottom end, each of said one or more rigid modular bodies further including a pair of flanges extending outward along a bottom end of each of the opposing side walls, said flanges being separated by a first distance, and further including an elongated channel that is disposed along an upper end of each of the front wall and the opposing side walls, said channel including a pair of nubs that are disposed within the channels at a complementary location to the first distance, wherein each of the flanges and channels include a complementary shape and dimension;

a receiver member that includes a rigid elongated hollow tubular shape having a front side wall, a back side wall and a pair of opposing side walls defining an open top end and an open bottom end; and a cartridge engagement unit that includes at least one spring and a follower, said unit having a size and shape that are configured to operate within each of the receiver member and the one or more modular bodies, wherein each of the butt plate and the receiver member further include at least one fastener.

2. The device of claim 1, wherein the cartridge engagement unit further includes a plurality of springs and at least one spring connector that is configured to align and stack two of the plurality of springs, each of said spring connectors including a generally planar middle portion that is in communication with an upper spring retention member and a lower spring retention member.

3. The device of claim 2, wherein each of the spring retention members include at least one of a protrusion and a generally hollow box-like structure.

4. The device of claim 2, wherein each of the plurality of springs include an identical length.

5. The device of claim 2, wherein at least one of the plurality of springs include a length that is different than a length of another of the plurality of springs.

6. The device of claim 1, further comprising:

a plurality of rigid modular bodies, each of said bodies including an identical length.

7. The device of claim 1, further comprising:

a plurality of rigid modular bodies, wherein at least one of the plurality of bodies includes a length that is different than a length of another of the plurality of bodies.

8. The device of claim 1, wherein the receiver member includes a shape that is complementary to a shape of a firearm magwell and is configured to be removably secured therein.

9. The device of claim 8, wherein the receiver member further includes at least one coupler that is configured to removably engage a mag-catch of the firearm.

10. The device of claim 1, wherein the butt plate fasteners include a pair of longitudinally extending grooves that are disposed along the side walls of the butt plate.

11. The device of claim 1, wherein the fasteners of the receiver member comprises:

a pair of flanges extending outward along a bottom end of each of the opposing side walls, said flanges being separated by the first distance.

12. The device of claim 1, wherein the butt plate is in communication with the bottom end of one of the rigid modular bodies;

the receiver member is in communication with the top end of the same rigid modular body; and the cartridge engagement unit is positioned within each of the receiver member and the one rigid modular body so that the at least one spring is in contact with the protrusion of the butt plate.

13. The device of claim 1, wherein each of the one or more rigid bodies and the receiver member includes a dimension suitable for receiving and storing a firearm cartridge.

14. The device of claim 1, wherein each of the one or more rigid bodies further includes an expansion gap that is disposed along the back wall at a location adjacent to a top surface thereof.

15. The device of claim 14, wherein each of the expansion gaps consists of:

an elongated narrow slit that extends from the top surface towards the bottom surface, said narrow slit terminating into an open section, wherein the expansion gap of each of the one or more rigid bodies functions to allow a width of the upper portion of a first rigid body to expand and contract the channels located thereon, in order to receive the flanges of a second rigid body.

* * * * *